US006973680B2

(12) United States Patent
Host

(10) Patent No.: US 6,973,680 B2
(45) Date of Patent: Dec. 13, 2005

(54) BED PAN APPARATUS

(76) Inventor: Patricia K. Host, 2322 Valentine Dr., Kokomo, IN (US) 46902

( * ) Notice: Subject to any disclaimer, the term of this patent is extended or adjusted under 35 U.S.C. 154(b) by 25 days.

(21) Appl. No.: 10/780,259

(22) Filed: Feb. 17, 2004

(65) Prior Publication Data

US 2005/0177934 A1 Aug. 18, 2005

(51) Int. Cl.[7] ..... A61G 9/00
(52) U.S. Cl. ..... 4/450
(58) Field of Search ..... 4/450

(56) References Cited

U.S. PATENT DOCUMENTS

| | | | | |
|---|---|---|---|---|
| 1,067,423 | A * | 7/1913 | Griffin | 4/450 |
| 1,085,549 | A * | 1/1914 | Cunning | 4/450 |
| 1,627,571 | A * | 5/1927 | Northrop | 4/450 |
| 1,872,809 | A * | 8/1932 | Randall | 4/450 |
| 1,918,083 | A * | 7/1933 | Coles et al. | 4/450 |
| 2,855,608 | A * | 10/1958 | Painter | 4/450 |
| 3,274,618 | A * | 9/1966 | Kahllo | 4/661 |
| 3,464,066 | A | 9/1969 | Marks | |
| 3,605,128 | A | 9/1971 | Oden | |
| D246,055 | S | 10/1977 | Mills | |
| D246,382 | S | 11/1977 | Parker, III | |
| D253,304 | S | 10/1979 | Nakao | |
| D270,018 | S | 8/1983 | Knight | |
| 5,079,788 | A | 1/1992 | Raupp | |
| 5,136,733 | A | 8/1992 | Church | |
| D450,840 | S | 11/2001 | Edmonds | |
| 6,532,604 | B2 | 3/2003 | Moser | |

* cited by examiner

*Primary Examiner*—Charles E. Phillips
(74) *Attorney, Agent, or Firm*—Frank D Lachenmaier

(57) ABSTRACT

This invention generally relates to bed pans. More specifically, this invention relates a novel slipper style bed pan design that dramatically reduces the pain and discomfort involved in its use.

7 Claims, 4 Drawing Sheets

BED PAN APPARATUS

BACKGROUND

1. Field of the Invention

This invention generally relates to bed pans. More specifically, this invention relates a novel slipper style bed pan design that dramatically reduces the pain and discomfort involved in its use.

2. Prior Art

Design Patents D246055 Mills 1977, D246382 Parker, III 1977, D253304 Nakao 1979, D270018 Knight 1983, & D450840 Edmonds 2001 all show different shapes and contours for the upper surface of a bed pan. Only Nakao is of the slipper style and its narrow top surface rails can cause significant discomfort when repeatedly forced against sensitive skin as required for a long term bedridden patients or forced against a patient who may have suffered from a pelvic or back injury. Also, its pistol grip handle does not provide sufficient stability to prevent accidental spills.

U.S. Pat. No. 3,464,066 Marks 1969 discloses a conventionally shaped bedpan but its sidewalls are inflatable so it can be stored flat and slid under the patient flat and inflated to elevate the patient for use. It doesn't mention getting out from under the patient. U.S. Pat No. 3,605,128 Oden 1971 takes the inflatable ring pan one step further having it mounted on a flat sheet that after use is lifted up around the pan making it into a sack which is then wholly disposable, eliminating costly cleaning and sterilization and is relatively economical to produce. U.S. Pat. No. 5,079,788 Raupp 1992 attempts to minimize the pain for users by its low lying configuration and providing contoured, padded surfaces that match the body contours of the user. It, however still requires lifting or rolling a patient on to it with the potential pain and strain. U.S. Pat. No. 5,136,733 Church 1992 add a seat of a flexible material wide enough to support the full width of the buttocks to more evenly distribute the user's weight as opposed to the relatively narrow top surface for the conventional pan but it still requires lifting or rolling the patient into position on top of the device for use. U.S. Pat. No.6,532,604 Moser 2003 seems more focused on improving the collecting function and the ease of cleaning than on the comfort of the user.

SUMMARY

An object of this invention is to provide a bedpan for use by bedridden patients dramatically reducing the pain and discomfort found in the use of prior art designs. Patients with spinal and pelvic injuries find it very painful if not impossible to be rolled on their side, a hard walled pan placed against their backside and then rolled back onto the bedpan. In accordance with the present invention, a bed pan apparatus is comprised of a slipper style bedpan, flat on the bottom, with a top surface sloping downward toward the patient. The top surface has an opening for receiving the bodily wastes from the patient. The top surface is significantly wider and longer than the bedpan underneath and is formed from a relatively flexible material. This additional width and length is the key to eliminating the pain of use as these wings deflect toward the bed surface as the apparatus is slid into functioning position without, rolling, pinching or abrading the sensitive local skin areas and with minimized lifting of the patients lower back required

DRAWINGS

In order that the invention may be more fully understood it will now be described by way of example, with reference to the accompanying drawings in which.

REFERENCE NUMERALS

10-Bedpan Apparatus
12-top surface
14-thumb grip
16-finger groove
18-leading edge
20-bottom surface
22-front wing
24-side wing
26-overhang
28-side wall
30-pan
32-front wall
34-back wall
36-opening
38-chamfer

DESCRIPTION

In order that the invention may be more fully understood, it will now be described by way of example with reference to the accompanying drawings in which FIGS. 1, 2, 4 and 5 illustrate a bed pan apparatus in its not-in-use state. FIGS. 3 and 6 illustrate the bed pan apparatus with its top surface flexed down to the bed surface, shown in phantom lines, as it would appear when pressed against the patient's buttocks ready for use.

Figure 1:
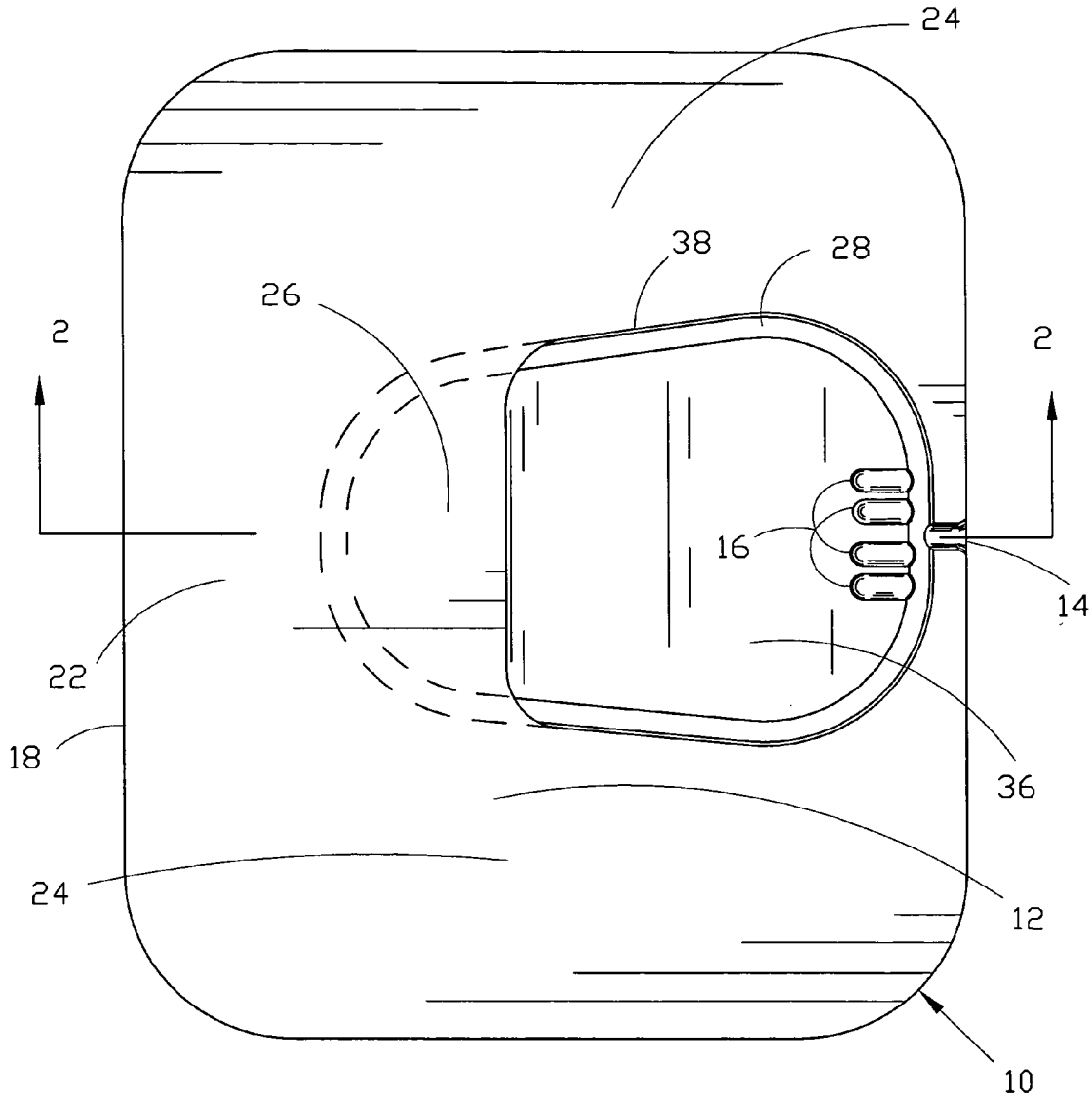
FIG. 1 is a top view of a bedpan apparatus.

Turning to FIG. 1, a top view of bedpan apparatus 10 shows top surface 12, which is a rectangular sheet approximately 18 in. wide by×15 in. long×3/32 in. thick, preferably of an engineering thermoplastic material suitable for repeated sterilizations. It also could be fabricated from metal and fastened to pan 30 below at sidewall 28. Top surface 12 slopes downward toward leading edge 18 as the depth of pan 30 is approximately 2 inches at its front wall 32 and approximately 5 inches at back wall 34. Top surface 12 includes opening 36 to receive the bodily waste from a bedridden patient. FIG. 1 also illustrates details for handling bedpan apparatus 10 including thumb grip 14 notched into top surface 12 at the top of back wall 34 and the four finger grooves 16 indented into bottom surface 20 starting at the bottom of back wall 34.

Figure 2:
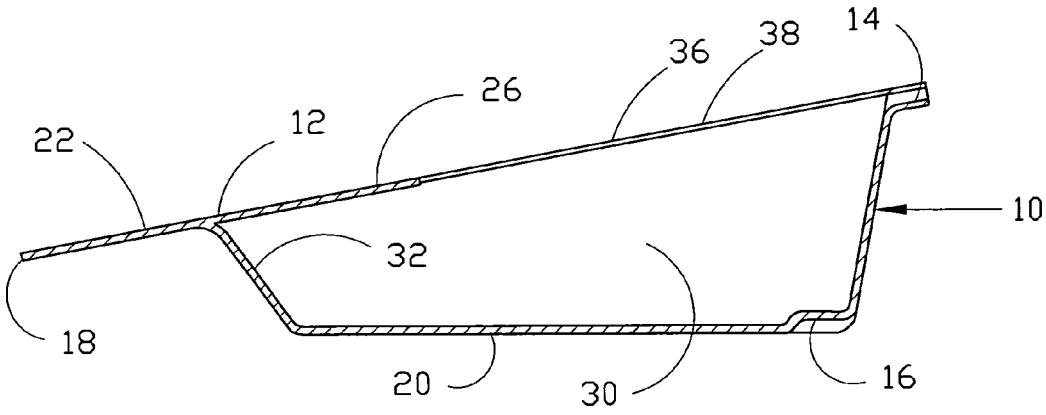
FIG. 2 is a sectional front view of a bedpan apparatus.
Figure 3:
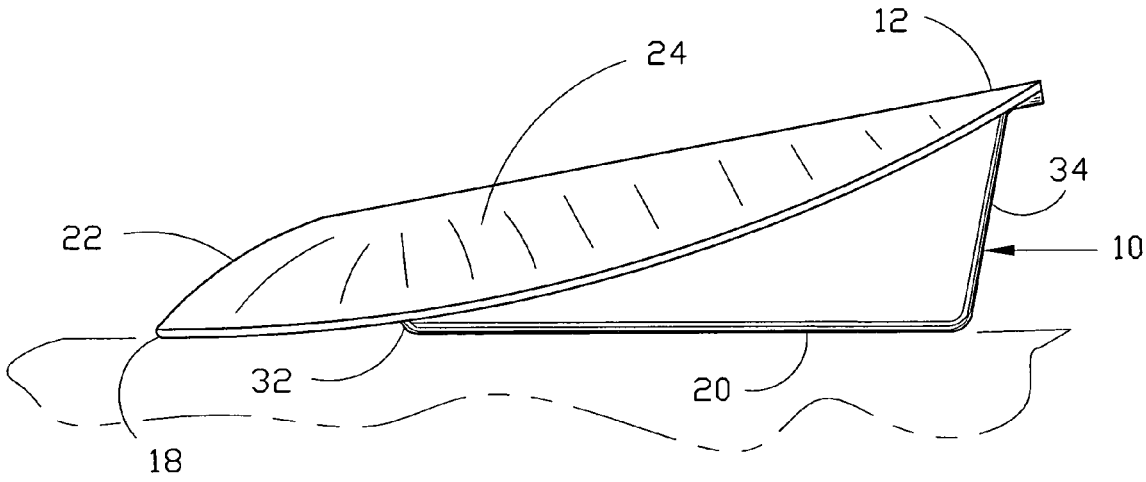
FIG. 3 is a front view of a bedpan apparatus with its support wings flexed.

FIG. 2 is a sectional front view of bedpan apparatus 10. This section view illustrates top surface 12 with its overhang 26 extending out over pan 30 allowing the working depth for liquid retention to be greater than the shallow end of pan 30 and also providing a splash shield. FIG. 2 also shows opening 36 for receiving the bodily wastes and chamfer 38 blending back wall 34 to top surface 12 with no sharp corners to scrape on patient's skin. It also shows bottom surface 20 of pan 30 which sets flat on the bed (not shown) or on a table prior to waste disposal. FIG. 2 also shows four finger grip grooves 16 indented into the bottom of bottom surface 20 and the opposing thumb grip groove14 in the back center of top surface 12 and back wall 34. These grooves make handling of bed pan apparatus 10 easy to manage with one hand allowing the caretaker the other hand free to assist in raising the bedridden patient slightly while working bedpan apparatus 10 into position for use.

FIG. 3 is a front view of a bedpan apparatus with its support wings 22 and 24 flexed. In this view, leading edge 18 is forced down against the bed surface, shown in phantom lines, under bedpan apparatus 10 by contact with the patient's buttocks and forward pressure by the caretaker. This flexing by leading edge 18 combined with large corner radii on top surface 12 allow the insertion of bedpan apparatus 10 into functional location with a dramatic reduction in patient discomfort, especially those with extended stays or back or pelvic injuries.

Figure 4:
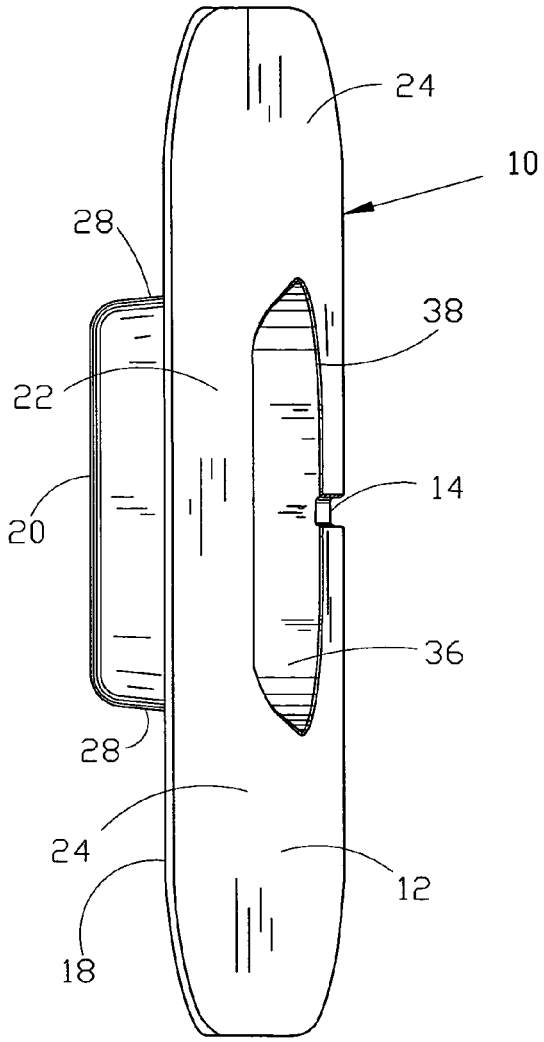
FIG. 4 is a left side view of a bedpan apparatus.

FIG. 4 is a left side view of bedpan apparatus 10. This view shows the sloping attitude of top surface 12 and its waste receiving opening 36 that has chamfer 38 blending top surface 12 into side walls 28 and back wall 34 leaving no sharp edges to scrape patient's skin.

Figure 5:
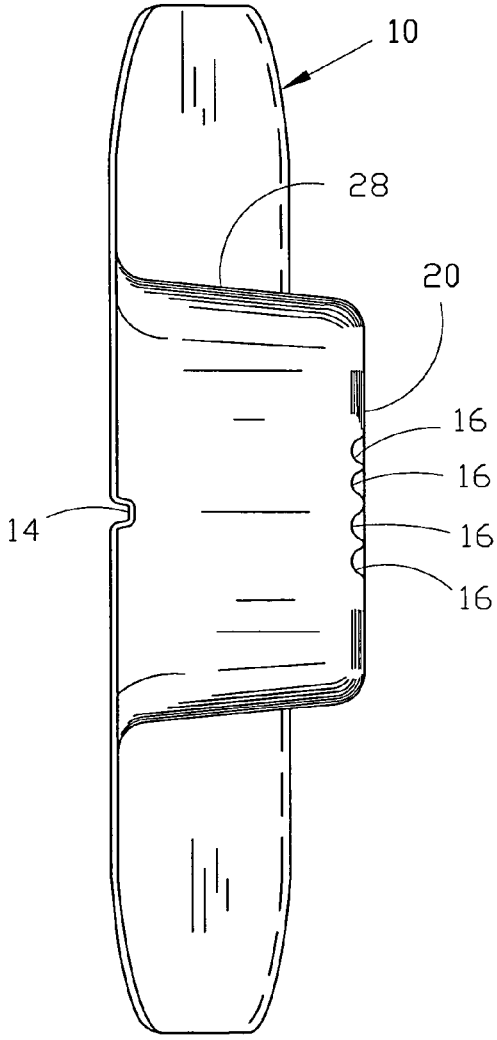
FIG. 5 is a right side view of a bedpan apparatus.
Figure 6:
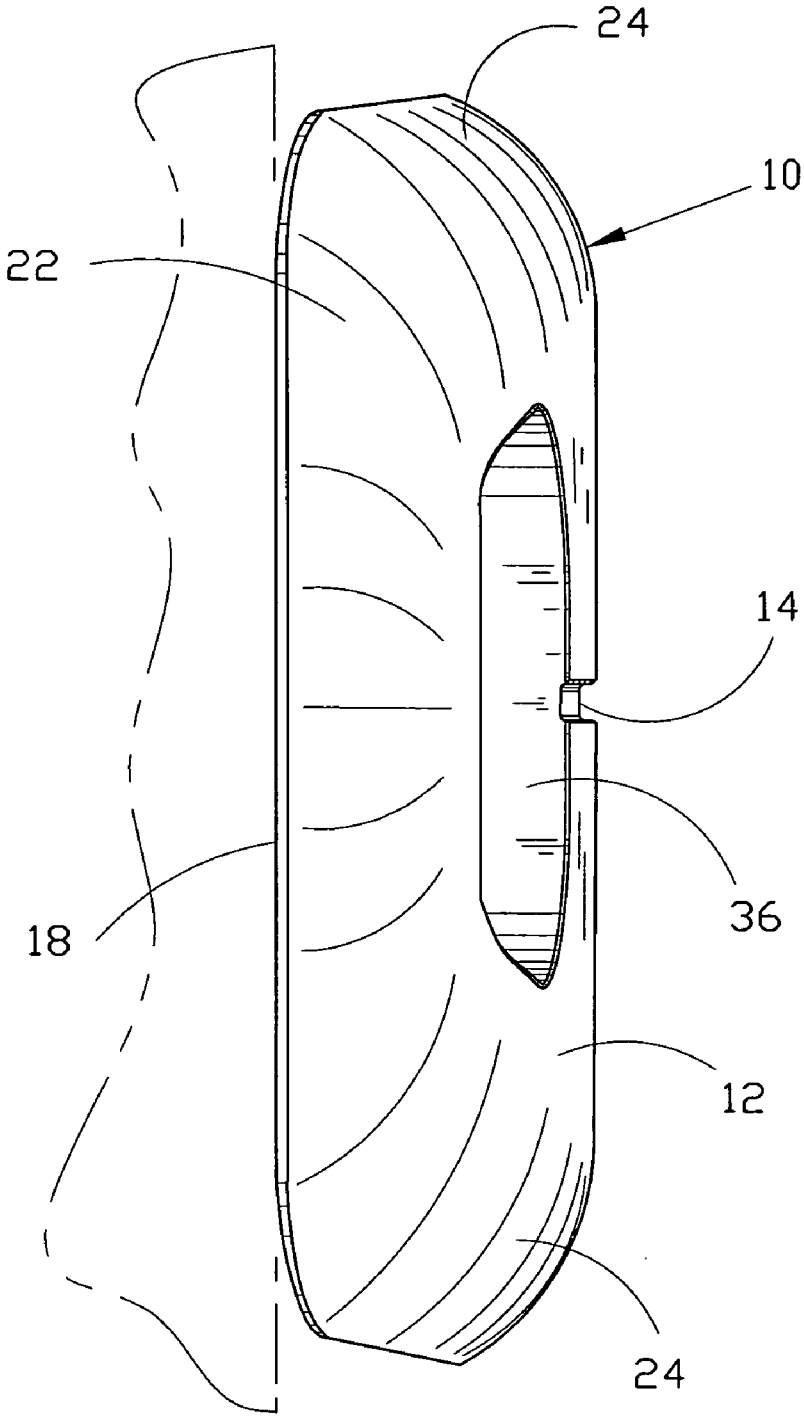
FIG. 6 is a left side view of a bedpan apparatus with its support wings flexed.

FIG. 5 is a right side view of a bedpan apparatus that illustrates thumb grip 14 dipping from top surface 12 into the top center of back wall 34 and four finger grooves 16 indenting into bottom surface 20 at the bottom of back wall 34. FIG. 5 also shows FIG. 6 is a left side view of a bedpan apparatus with its support wings flexed illustrating the shape of bedpan apparatus 10 after it has been positioned for use. In this view, leading edge 18 has been deflected down to the bed surface, shown in phantom lines, by movement towards patient's buttocks which causes front wing 22 to bow downward from the top of front wall 32. Side wings 24 also deflect downward as the weight of the patient's legs rest on top surface 12.

The preceding descriptions are for illustrative purposes and are not intended to limit the scope of this invention. The scope of the invention should be determined by the appended claims rather than by the specific examples given.

The invention claimed is:

1. A bedpan apparatus to permit a user to dispose of bodily waste, said bedpan apparatus having a bottom surface, side walls, a back wall, a front wall and a top surface with a leading edge, forming a waste reservoir or pan comprising:

a rectangular sheet of flexible material that is attached on top of said pan, said rectangular sheet having an opening for receiving bodily waste from said user, said opening being collinear with said back wall and side walls but only reaching about half the distance to said front wall;

said rectangular sheet overhanging said side walls and said front wall by a sufficient distance, approximately 5 inches, to allow said leading edge to deflect easily down to bed level when positioned against the user's buttocks by caretaker;

said back wall is taller than said front wall, approximately 5 inches, and said side walls taper down from said back wall to said front wall which is approximately 2 inches tall, causing said rectangular sheet to slope from the back wall to said leading edge;

said bedpan apparatus is molded from an engineering thermoplastic that can survive numerous sterilizations or stamped from metal;

wherein all edges that contact said user's skin are appropriately chamfered, radiused or broken to prevent scraping of sensitive skin; and said bedpan apparatus has a thumb grip contour in the center of the top of said rear wall and four finger grooves indented into bottom of said rear wall and said bottom surface to allow easy one handed insertion and extraction of said bed pan apparatus and handling during cleanup or disposal.

2. A bedpan apparatus to permit a user to dispose of bodily waste, said bedpan apparatus having a bottom surface, side walls, a back wall, a front wall and a top surface with a leading edge, forming a waste reservoir or pan comprising:

a rectangular sheet of flexible material that is attached on top of said pan; said rectangular sheet has an opening for receiving bodily waste from said user, said opening being collinear with said back wall and side walls but only reaching about half the distance to said front wall; said rectangular sheet overhanging said side walls and said front wall by a sufficient distance to allow said leading edge to deflect easily down to bed level when positioned against the user's buttocks by a caretaker; said back wall is taller than said front wall and said side walls taper down from said back wall to said front wall causing said rectangular sheet to slope from the back wall to said leading edge; wherein said bedpan apparatus has a thumb grip contour in the center of the top of said rear wall and four finger grooves indented into the bottom of said rear wall and said bottom surface to allow easy one handed insertion and extraction of said bed pan apparatus and handling during cleanup or disposal.

3. A bedpan apparatus as defined in claim 2 wherein said bedpan apparatus is molded from an engineering thermoplastic that can survive numerous sterilizations.

4. A bedpan apparatus as defined in claim 2 wherein said bedpan apparatus is made from metal.

5. A bedpan apparatus as defined in claim 2 wherein said back wall is approximately 5 inches tall and said front wall is approximately 2 inches tall.

6. A bedpan apparatus as defined in claim 2 wherein all edges that contact said user's skin are appropriately chamfered, radiused or broken to prevent scraping of sensitive skin.

7. A bedpan apparatus as defined in claim 2 wherein said rectangular sheet overhangs beyond said side walls and front wall approximately five inches.

* * * * *